US006163979A

United States Patent [19]

Oetjen et al.

[11] Patent Number: 6,163,979

[45] Date of Patent: Dec. 26, 2000

[54] METHOD FOR CONTROLLING A FREEZE DRYING PROCESS

[75] Inventors: Georg-Wilhelm Oetjen, Lübeck; Peter Haseley, Meckenheim; Hübert Klütsch, Köln; Marion Leineweber, Hürth, all of Germany

[73] Assignee: Steris GmbH, Hurth, Germany

[21] Appl. No.: 09/423,477

[22] PCT Filed: Apr. 21, 1998

[86] PCT No.: PCT/EP98/02335

§ 371 Date: Mar. 20, 2000

§ 102(e) Date: Mar. 20, 2000

[87] PCT Pub. No.: WO98/50744

PCT Pub. Date: Nov. 12, 1998

[30] Foreign Application Priority Data

May 7, 1997 [DE] Germany ..... 197 19 398

[51] Int. Cl.[7] ..... F26B 5/06

[52] U.S. Cl. ..... 34/286; 34/292; 34/92; 34/495

[58] Field of Search ..... 34/284, 286, 287, 34/292, 60, 61, 92, 493, 494, 495; 62/100, 268

[56] References Cited

U.S. PATENT DOCUMENTS

| | | | |
|---|---|---|---|
| 4,780,964 | 11/1988 | Thompson, Sr. | 34/5 |
| 5,035,065 | 7/1991 | Parkinson | 34/92 |
| 5,154,007 | 10/1992 | Piunno et al. | 34/92 X |
| 5,280,678 | 1/1994 | Jennings | 34/493 |
| 5,367,786 | 11/1994 | Jennings | 34/245 |
| 5,428,905 | 7/1995 | Beurel et al. | 34/289 |

FOREIGN PATENT DOCUMENTS

| | | |
|---|---|---|
| 1354/66 | 8/1967 | Australia . |
| 0 546932A1 | 12/1992 | European Pat. Off. . |
| 1038988 | 9/1958 | Germany . |
| 1135828 | 8/1962 | Germany . |
| 2743993A1 | 4/1978 | Germany . |
| 1587409 | 4/1981 | United Kingdom . |
| WO 95/30118 | 11/1995 | WIPO . |
| WO 96/25654 | 8/1996 | WIPO . |

*Primary Examiner*—Stephen Gravini

*Attorney, Agent, or Firm*—Fay, Sharpe, Fagan, Minnich & McKee, LLP

[57] ABSTRACT

In a method for controlling a freeze drying process, a frozen product is arranged on temperature controlled surfaces (12) in an air-evacuated chamber (1) and undergoes a main drying and after-drying phase. During the main drying phase, the temperature of the ice surrounding said product is continuously measured. The pressure in the chamber and/or the temperature of the surfaces are modified during transition from the main drying phase to the after-drying phase. In order to avoid longer idle periods between the chamber (1) and the evacuation device (3, 4, 14) and to determine transition from the main drying phase to the after-drying phase, the pressure and/or the temperature of the surfaces during said transition are modified according to changes int he temperature of the ice.

8 Claims, 3 Drawing Sheets

METHOD FOR CONTROLLING A FREEZE DRYING PROCESS

BACKGROUND OF THE INVENTION

The present invention relates to a method for controlling a freeze-drying process. It finds particular application in processes in which a frozen product is arranged on temperature adjustable surfaces in an air-evacuated chamber that is first subject to a main drying phase and subsequently to an after-drying phase. During the main drying phase, the temperature of ice enclosed in the product to be dried is continuously measured. The chamber pressure and/or the temperature of the storage surfaces are modified during a transition from the main drying phase to an after-drying phase.

Freeze-drying is a method for removal of water from a water-containing frozen product, for example from pharmaceutical products or food items. In general, the process is performed at an air pressure which is low vis-a-vis the water vapor pressure at the selected temperature of the ice. For example, an ice temperature of −20° C. corresponds to a water vapor pressure (in equilibrium) of 1.03 mbar. In order for the water vapor to be able to flow from the surface of the ice into the drying chamber, the water vapor pressure in the drying chamber must clearly be lower than 1.03 mbar, e.g., 0.4 mbar. Thus, it is appropriate to select relative to said pressure value a low pressure, for example, 0.05 mbar. Freeze-drying is normally done in a chamber in which temperable storage surfaces are located with an attached evacuation device, for example, an ice condenser combined with a vacuum pump.

Basically, two drying phases are characteristic for the course of the drying process. As long as there is still crystallized (frozen) water within the product, said drying phase is called main or sublimation drying. If the shut-off device between the chamber and the evacuation device is cut off for only a brief period of time (a few seconds) during this drying phase, equilibrium water vapor pressure becomes established inside the chamber which corresponds to the prevailing temperature of the ice.

From the rise in pressure, a direct conclusion can be drawn with respect to the temperature of the ice. Said method for measuring the ice temperature is known under the concept of barometric temperature measuring and is described, for example, in DE-PS 10 38 988.

As long as solid ice is present in the product, i.e., during the main drying phase, the temperature of the product must not rise above certain values, ranging, in most cases, far below 0° C. in order to avoid impairment of the quality and/or the properties of the product. With progressing drying, the ice nuclei present in the product continue to decrease. In the area of dry marginal zones, higher temperatures are already permissible.

When water is no longer present in the form of ice, the remaining water has been absorbed by the dry product or more or less firmly bonded thereto as well. Removal of this remaining water takes place during the after-drying or desorption drying phase. The quantity of water which can be desorbed during this phase depends upon the temperature of the product, the type of water bonding, and the quality of the still present water. The after-drying phase is initiated by another modification in the physical conditions governing the course of the drying process.

A method of the initially mentioned type is known from the reference DE-PS 10 38 988. For determining the transition from the main drying phase to the after-drying phase, measurements are taken by means that also serve to measure the temperature of the ice. To that end, the shut-off times, which last only a few seconds when measuring the temperature of the ice, are substantially lengthened, i.e., to two minutes or longer.

If, after shut-off times of this magnitude, there occurs an almost constant difference between the operating pressure and the saturation vapor pressure, it may be assumed that the solid ice has been completely removed from the product and that the main drying phase is, in fact, completed. The storage surface temperature and the pressure can be adjusted to the particular values at which the after-drying phase is there to take place.

The substantial lengthening of the shut-off time is a disadvantage with respect to the described method. If the main drying phase has not been completed as yet, there is the danger than an extension of the shut-off time will result in a no longer permissible temperature increase of the ice-containing product and thus lead to its destruction. In modern freeze-drying plants of the pharmaceutical industry, the value of one batch is frequently over $600,000. Therefore, it is important to avoid product endangerment.

The present application proposes a method for controlling a freeze-drying process of the initially mentioned type, wherein the drawback of longer shut-off times between chamber and evacuation device are not necessary.

The modifications in the pressure and/or the storage surface temperature, characterizing the transition from the main drying phase of the after-drying phase, are carried out subject to changes in the ice temperature. This process makes use of the phenomenon that the values of the ice temperature measured during the main drying phase become smaller during the transition from main drying to after-drying. Obviously, the only apparent modification of the ice temperature is, in fact, minor, but can be accurately determined with the aid of modern computers. Since measurements of only the ice temperature are taken during brief shut-off times, the danger of product-thawing is avoided.

During the main drying phase, the ice nuclei present in the product, become smaller and smaller. In many instances, following the formation of dry marginal zones, there exists the possibility of already increasing the temperature of the storage surfaces during the main drying phase without endangering the quality of the product. Modification of the drying conditions of this type can also be made according to the invention in dependence on modifications of the ice temperature.

The ice temperature values measured during the main drying phase changed very little. Therefore, it is appropriate to average the measured values of the ice temperature with the preceding measured values and, in order to determine a given change in the temperature of the ice, to continuously compare the highest of the ascertained ice temperature averages with the respective actual values of the ice temperature. Changes in ice temperature by 1.2° C. or 3° C., for example, can clearly be ascertained according to this process.

Measurement-taking of the ice temperature itself is appropriately done according to the initially mentioned barometric temperature measuring, i.e., a conclusion is drawn as to the temperature of the ice from the rise in the pressure of the chamber, which occurs after the isolation of the chamber from its evacuation device. In order to keep the shut-off times as short as possible in accordance with a general aim of the invention, the following procedure is suggested. After shutting off the chamber from the evacuation device, the rising chamber pressure is continuously measured 10 to 100 times per second. These measured values are entered into a computer. The values measured in the first seconds of the rise in pressure produce an S-shaped curve, i.e., a curve with a turning point. With the aid of the computer, said curve is continuously differentiated, in other words, the temporary modification of the pressure (dp/dt) is being monitored. The measurement-taking of the rise in pressure, needed for sufficiently precise determination of the ice temperature, may be interrupted when the pressure increase curve has reached its turning point, in other words, when the first derivative of said curve has reached its maximum. At that moment it is possible, therefore, to terminate the shut-off time and to re-establish the connection between the chamber and the evacuation device. This prevents the ice temperature from being surpassed.

The continuous, short-term and relatively precise determination of the ice temperature permits very early ascertainment of ice temperature fluctuations which exceed the measuring accuracy. If fluctuations in the chamber pressure or the storage surface temperature are excluded, then fluctuations in the temperature of the ice are an indication of an incongruity in the ice structure. Thermal conductance and water vapor transport differ in zones with very small or aggregated large crystals. This also applies with respect to products collapsed during the main drying phase, since at that point in time, water instead of ice is present in several zones. Fluctuations in the temperature of the ice may thus indicate errors during freezing of the product or storage surface temperatures which are too high.

BRIEF DESCRIPTION OF THE DRAWINGS

The invention may take form in various components and arrangements of components, and in various steps and arrangements of steps. The drawings are only for purposes of illustrating preferred embodiments and are not be construed as limiting the invention.

DETAILED DESCRIPTION OF THE PREFERRED EMBODIMENTS

Figure 1:
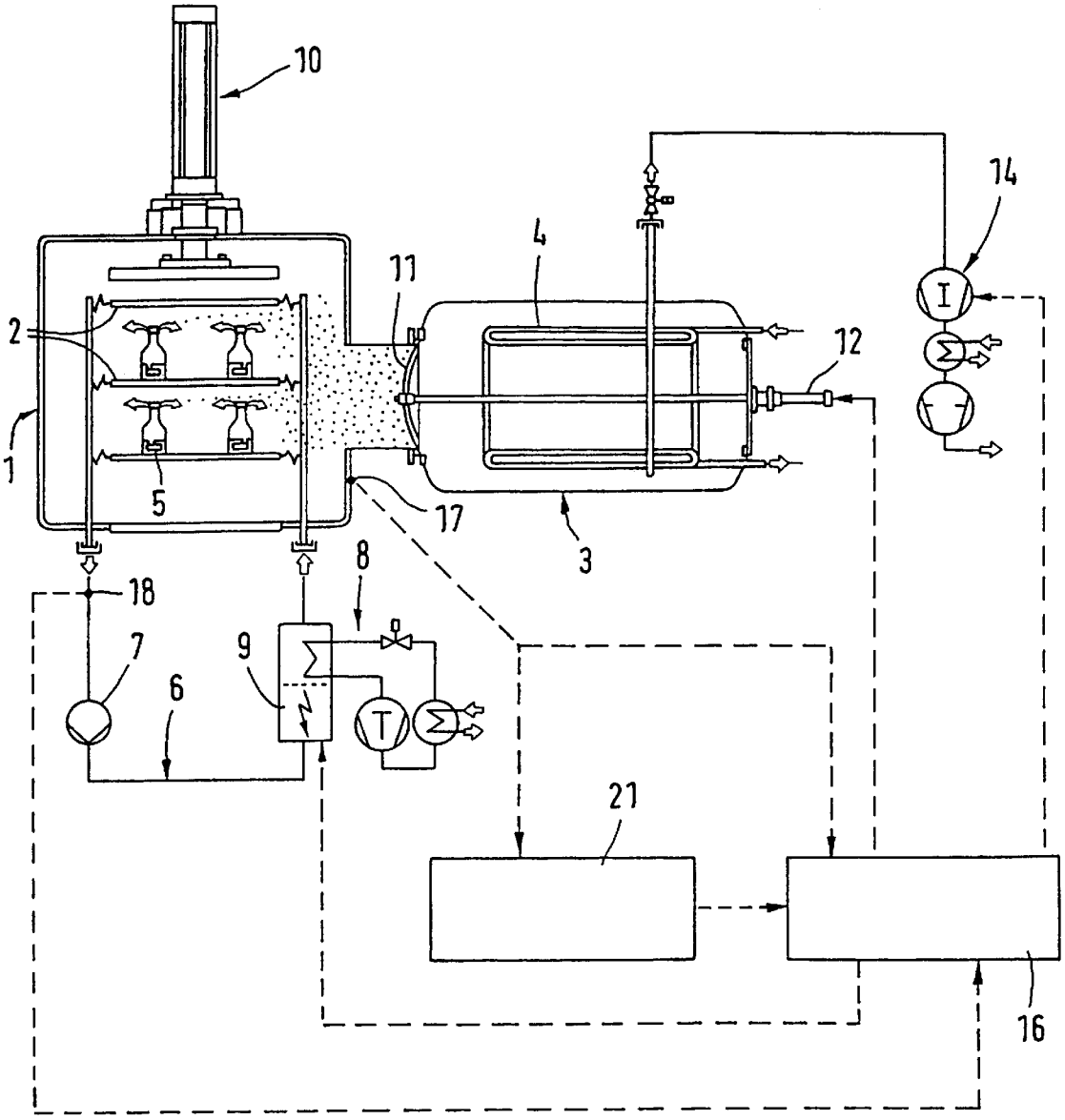
FIG. 1 shows a schematic representation of a device for performing a freeze/drying process.

With reference to FIG. 1, a freeze/drying device includes a chamber 1 with storage surfaces 2 and an attached condenser 3 having condensation surfaces 4. Containers (typically small bottles 5) holding product to be freeze-dried are located on the storage surfaces. The storage surfaces 2 are temperature adjustable. They are a component of a temperature control circuit 6 with a conveyor pump 7 and a refrigerating machine 8. During a heating phase, the refrigerating machine is turned off and a refrigerating/heating medium is electrically heated by heating unit 9. The equipment 10 serves to close the small bottles 5 within the chamber 1 and after drying has taken place.

Between the chamber 1 and the condenser 3, there is a valve 11, which is actuated with the aid of an actuator 12. Down-stream from the condenser 3 is a vacuum pump assembly or combination 14. Control means are provided for controlling the course of the freeze/drying process. Data with respect to the pressure in the chamber 1 and with respect to the temperature of the storage surfaces 2 are continuously fed into a central control by pressure and temperature sensors 17, 18. Only one temperature sensor 18 is represented in the temperature control circuit 6. Preferably, the exit of each storage surface 2 is equipped with a temperature sensor.

In the represented exemplary embodiment, a control 16 is in communication with the vacuum pump assembly 14, the refrigeration medium evaporator 8, and the actuation element 12 of the valve. Pressure control in chamber 1 takes place by turning-on and turning-off the vacuum pump assembly 14 or by controlled inert gas introduction. The temperature of storage surfaces is adjusted with the aid of the refrigeration machine 8 or the heating unit 9. The shut-off valve 11 is also actuated with the aid of the control 16, in order to measure the temperature of the ice, in a known fashion.

The control 16 is linked to a computer 21. Signals provided by the pressure sensor 17 are likewise supplied to the computer. The computer 21 continuously monitors, as described earlier, the temporary modification of the pressure (dp/dt) after the valve 11 is shut off. Immediately after the maximum of said derivative value is surpassed, the control 16 receives the signal to terminate the shut-off time.

Figure 2:
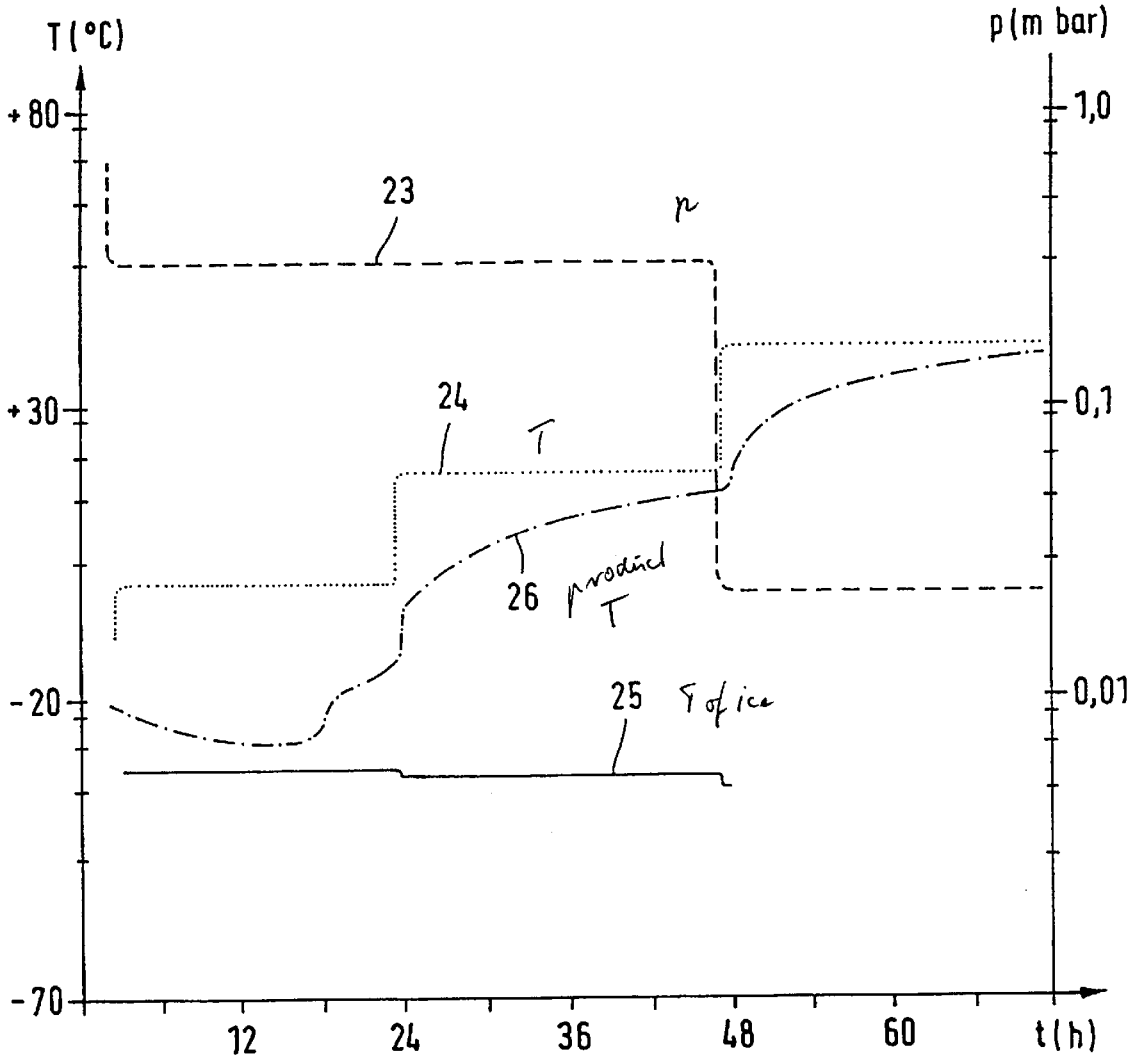
FIG. 2 is a diagram illustrating data of pressure (mbar) and temperature (°C.) versus time (hours) that is read and deduced over the course of a freeze/drying process.

The diagram according to FIG. 2 provides exemplary information of the temporary course of a freeze/drying process. The Y-orientation indicates storage surface temperature values and pressure values. A dashed curve 23 shows the course of the chamber pressure. A dotted line 24 indicates the course of the storage surface temperature. A solid line 25 provides data on the continuously measured ice temperature values. Finally, a "dot-dash-dot" line 26 indicates an average product temperature.

A freeze/drying process of the described type commences with loading the frozen product into the chamber 1. Subsequently, the chamber is air-evacuated and the storage surfaces 2 are heated to the desired temperature. A thermodynamic equilibrium occurs, during which the main drying takes place. The main drying phase lasts approximately 48 hours with respect to the represented exemplary embodiment. During this time, the pressure (curve 23) is held at a given pressure. The storage plate temperature (curve 24) is likewise adjusted to given values. In the illustrated exemplary embodiment, the storage surface temperature is raised after 24 hours. Following a drop in the ice temperature, the pressure control is turned off. The storage surface temperature is further increased. In this phase of the after-drying, the control 16 and the computer 21 can be utilized for ascertaining the residual moisture. This is preferably done according to a process as described in the International Patent Application WO 96/25654. In said process, the residual moisture is obtained from measurements of the desorption rate DR.

$$DR\left(\text{water in \% dry substance per hour}\right) = \frac{\text{Mass of desorbed water} \times 100}{\text{hours} \times \text{mass of dry substance}}$$

With this process, the desorption rate during the after-drying phase is measured at certain intervals (for example 10 minutes), the computer calculates on the basis of two or more of these measured values, the time at which the desorption rate is projected to be reached (desorption rate zero point) which would modify the desired residual moisture only by an acceptable small amount, and, accordingly, ascertain by the computer the respective residual moisture via temporal integration of the desorption rates from zero until the time of measuring.

The modifications of the chamber pressure and the storage surface temperature are made in dependence upon modifications in the ice temperature. In the represented exemplary embodiment, the pressure values and the values of the storage surface temperature characterizing the after-drying are carried out if there is a change of more than 2–3° C. in the temperature of the ice vis-a-vis a maximum average value. Increases in the storage surface temperature during the main drying phase can also be carried out in dependence on modifications of the ice temperature. In the represented exemplary embodiment, this occurs when the ice temperature changes by more than 1° C. vis-a-vis the maximum average value.

Figure 3:
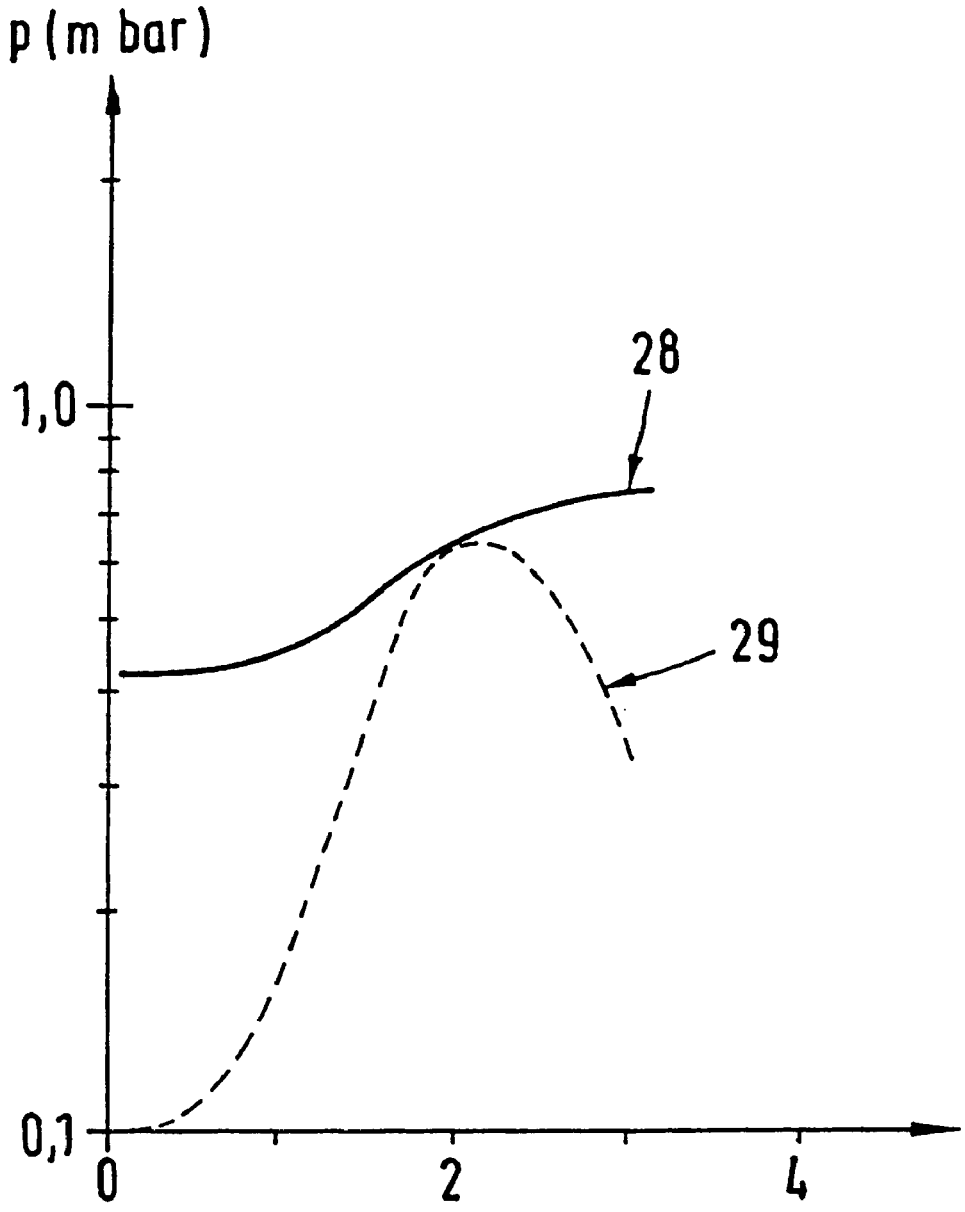
FIG. 3 is another diagram illustrating determination of ice temperature according to the invention.

FIG. 3 is the diagram in which a solid curve 28 depicts the rise in pressure which occurs between the chamber 1 and the condenser 3 after the valve is shut off. This curve is continuously differentiated (dashed curved 29)by the computer 21. This makes it possible to continuously ascertain the temporary modification of the chamber pressure. As already described, the measurement-taking may be interrupted if the temporary modification of the pressures surpasses a maximum.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A method for controlling a freeze/drying process of a frozen product to be dried that is received on temperature adjustable storage surface in an air-evacuated chamber, the method comprising:

continuously measuring the temperature of ice enclosed in the frozen product to be dried during a main drying phase;

modifying at least one of the chamber pressure and the storage surface temperature during a transition from the main drying phase to an after-drying phase, the modifying of the transition from the main drying phase to after-drying phase of the at least one of the pressure and the storage surface temperature being carried out in dependence on a drop in the ice temperature.

2. The method according to claim 1 wherein at least one of the chamber pressure and the storage surface temperature are also modified during the main drying phases which main drying phase modifications are carried out in dependence upon changes of the ice temperature.

3. The method according to claim 1 wherein the measured ice temperatures are averaged with preceding measured ice temperature and and further including:

continuously comparing a highest of the measured ice temperature average with each actually measured ice temperature.

4. The method according to claim 1 wherein measuring the ice temperature includes:

continuously measuring a rise in pressure taking place after isolating the chamber from an evacuation device.

5. The method according to claim 4 further including:

following isolation of the chamber from the evacuation device, continuously measuring a rise in chamber pressure and supplying the measured pressures to a computer, the computer continuously determining temporal changes of the pressure rise until the rise in pressure stops and, concurrently, reestablishing a connection between the chamber and the evacuation device.

6. The method according to claim 1 further including:

following the transition from the main drying phase to the after-drying phases determining a residual moisture still existing in the product to be dried.

7. The method according to claim 6 wherein determining the residual moisture includes:

measuring desorption rate values at preselected intervals during the after-drying phase;

calculating from at least two of the measured desorption rate values a point in time at which the desorption rate is projected to reach a rate zero point rate at which a preselected residual moisture changes by only a preselected small amount; and thereafter, ascertaining the respective residual moisture by a computer via time integration of the measured desorption rate values from the zero point to a current desorption rate measurement-taking.

8. A freeze dryer for freeze/drying a frozen product the freeze dryer comprising:

an air-evacuated chamber;

temperature controlled storage surfaces disposed in the air-evacuated chamber for supporting the frozen product;

a control for controlling at least one of a chamber pressure and a storage surface temperature during a transition from a main drying phase to an after-drying phase, changes in at least one of the pressure and the storage surface temperature distinguishing the transition from the main drying phase to the after-drying phase in dependency on a drop in the ice temperature, a computer which receives at least one of pressure and temperature measurements of temperature of the storage surfaces and pressure in the chamber and calculates a temperature of ice in the product to be dried, the computer being connected with the control such that the control modifies at least one of the pressure in the chamber and the temperature of the storage surfaces in dependence on values supplied by the computer.

* * * * *